US012742408B2

(12) United States Patent
Malinverno et al.

(10) Patent No.: US 12,742,408 B2
(45) Date of Patent: Sep. 22, 2026

(54) ESTIMATION METHOD FOR DETERMINING THE OXYGEN STORAGE CAPACITY OF A CATALYTIC CONVERTER

(71) Applicant: FERRARI S.P.A., Modena (IT)

(72) Inventors: Fabio Malinverno, Modena (IT); Gabriele Lucchesi, Modena (IT); Luca Brocchi, Modena (IT); Matteo Cucchi, Modena (IT)

(73) Assignee: FERRARI S.P.A., Modena (IT)

( * ) Notice: Subject to any disclaimer, the term of this patent is extended or adjusted under 35 U.S.C. 154(b) by 0 days.

(21) Appl. No.: 19/271,463

(22) Filed: Jul. 16, 2025

(65) Prior Publication Data

US 2026/0022651 A1 Jan. 22, 2026

(30) Foreign Application Priority Data

Jul. 19, 2024 (IT) ..... 102024000016816

(51) Int. Cl.
*F01N 11/00* (2006.01)

(52) U.S. Cl.
CPC ..... *F01N 11/007* (2013.01); *F01N 2430/06* (2013.01); *F01N 2550/02* (2013.01); *F01N 2900/04* (2013.01); *F01N 2900/0416* (2013.01)

(58) Field of Classification Search
CPC combination set(s) only.
See application file for complete search history.

(56) References Cited

U.S. PATENT DOCUMENTS 8,434,294 B2 5/2013 Arlt et al.
8,484,946 B2 7/2013 Arlt et al.
(Continued)

FOREIGN PATENT DOCUMENTS

CN 114729587 A 7/2022

OTHER PUBLICATIONS

Italian Search Report and Written Opinion for Italian Application No. 102024000016816; Date of Mailing: Dec. 5, 2024, 7 pages.

*Primary Examiner* — Binh Q Tran
(74) *Attorney, Agent, or Firm* — CANTOR COLBURN LLP

(57) ABSTRACT

An estimation method for determining the oxygen storage capacity of a first catalytic converter, which is arranged upstream of a second catalytic converter along an exhaust duct of an internal combustion engine. The estimation method provides for the steps of: carrying out an initial combustion phase, in which the combustion takes place with a lean air-fuel mixture at least until a first oxygen probe arranged downstream of the second catalytic converter signals a switch to a lean air-fuel mixture; carrying out an intermediate combustion phase immediately following the initial combustion phase and in which the combustion takes place with a rich air-fuel mixture at least until a second oxygen probe arranged downstream of the first catalytic converter signals a rich air-fuel mixture; and carrying out a final combustion phase immediately following the intermediate combustion phase and in which the combustion takes place with a lean air-fuel mixture after the second oxygen probe signals a rich air-fuel mixture and at least until the second oxygen probe signals a lean air-fuel mixture.

14 Claims, 3 Drawing Sheets

(56) References Cited

U.S. PATENT DOCUMENTS

| | | | | |
|---|---|---|---|---|
| 2002/0152743 | A1* | 10/2002 | Nakamura | F02D 41/126 60/285 |
| 2005/0028517 | A1* | 2/2005 | Nakagawa | F01N 3/30 60/285 |
| 2007/0113538 | A1* | 5/2007 | Kato | F01N 13/0093 60/276 |
| 2009/0145109 | A1* | 6/2009 | Kidokoro | F01N 13/009 60/276 |
| 2009/0288391 | A1* | 11/2009 | Aoki | F01N 11/007 123/704 |
| 2017/0037757 | A1* | 2/2017 | Tanaka | F02D 41/1455 |
| 2020/0182116 | A1* | 6/2020 | Umezawa | F02D 41/1456 |

* cited by examiner

ESTIMATION METHOD FOR DETERMINING THE OXYGEN STORAGE CAPACITY OF A CATALYTIC CONVERTER

CROSS-REFERENCE TO RELATED APPLICATIONS

This patent application claims priority from Italian patent application no. 102024000016816 filed on Jul. 19, 2024, the entire disclosure of which is incorporated herein by reference.

TECHNICAL FIELD

The present invention relates to an estimation method for determining the oxygen storage capacity of a catalytic converter of an internal combustion engine.

PRIOR ART

Homologation regulations require to perform a diagnosis of the catalytic converter after starting the internal combustion engine.

In particular, the diagnosis of the catalytic converter is performed by determining the oxygen storage capacity (also called "OSC") which is directly linked to the efficiency and the condition of the catalytic converter; namely, the oxygen storage capacity is a key indicator of the functionality of the catalytic converter, in particular for three-way catalytic converters used in gasoline engines for reducing the emissions of nitrogen oxides (NOX), carbon monoxide (CO) and unburned hydrocarbons (HC).

A three-way catalytic converter operates by storing and releasing oxygen during the operation of the internal combustion engine and this process helps to maintain the correct air-fuel ratio for optimizing the conversion of the unburned gases coming from the combustion chamber: a catalytic converter with a good oxygen storage capacity can better compensate possible variations in the air-fuel ratio coming from the combustion chamber, improving the efficiency of the conversion of the harmful gases. A reduced oxygen storage capacity can indicate a deterioration (ageing) of the catalytic converter due to the degradation of the active materials or the presence of contaminants (sulphur, lead or other impurities that can be found in low-quality fuels) which reduce the effectiveness thereof.

During the diagnosis, for determining the oxygen storage capacity of a catalytic converter, the signals provided by the oxygen probe (also called lambda probe) arranged downstream of the catalytic converter are used: initially, in the cylinders, the combustion with a rich air-fuel mixture (namely with excess fuel and too little oxygen with respect to the stoichiometric ratio) is caused to take place for depleting the previously stored oxygen and subsequently the combustion with a lean air-fuel mixture (namely with too little fuel and excess oxygen with respect to the stoichiometric ratio) is caused to take place for allowing the catalytic converter to store oxygen. During the combustion with a lean air-fuel mixture, the amount of oxygen that the catalytic converter is capable of storing is determined estimating the amount of oxygen entering the catalytic converter from the moment when the combustion with a lean air-fuel mixture begins until the moment when the oxygen sensor arranged downstream of the catalytic converter senses an increase in the concentration of oxygen (corresponding to the moment when the catalytic converter, previously emptied of the oxygen, has depleted the capacity to store further oxygen and thus begins to make the no longer stored oxygen exit).

This procedure is efficient and effective but causes, during the combustion with a rich air-fuel mixture, a sensitive increase in the release of carbon monoxide (CO).

Patent KR101176685B1 and patent application DE102005024872A1 describe a method for determining the oxygen storage capacity of a catalytic converter of the exhaust gases of an internal combustion engine and for determining the dynamic duration of the probes of the exhaust gases of the internal combustion engine.

Patent application CN114729587A describes a method for diagnosing an aftertreatment system of a spark ignition engine comprising a three-way catalytic converter associated with a proportional upstream oxygen probe and a binary downstream oxygen probe.

DESCRIPTION OF THE INVENTION

The object of the present invention is to provide an estimation method for determining the oxygen storage capacity of a catalytic converter which allows reducing the polluting emissions and in particular the emissions of carbon monoxide (CO) without penalizing the emissions of nitrogen oxides (NOx).

According to the present invention, an estimation method for determining the oxygen storage capacity of a catalytic converter is provided, in accordance with what claimed by the appended claims.

The claims describe preferred embodiments of the present invention forming integral part of the present description.

BRIEF DESCRIPTION OF THE DRAWINGS

The present invention will now be described with reference to the accompanying drawings, which illustrate a non-limiting example embodiment thereof, wherein.

PREFERRED EMBODIMENTS OF THE INVENTION

Figure 1:
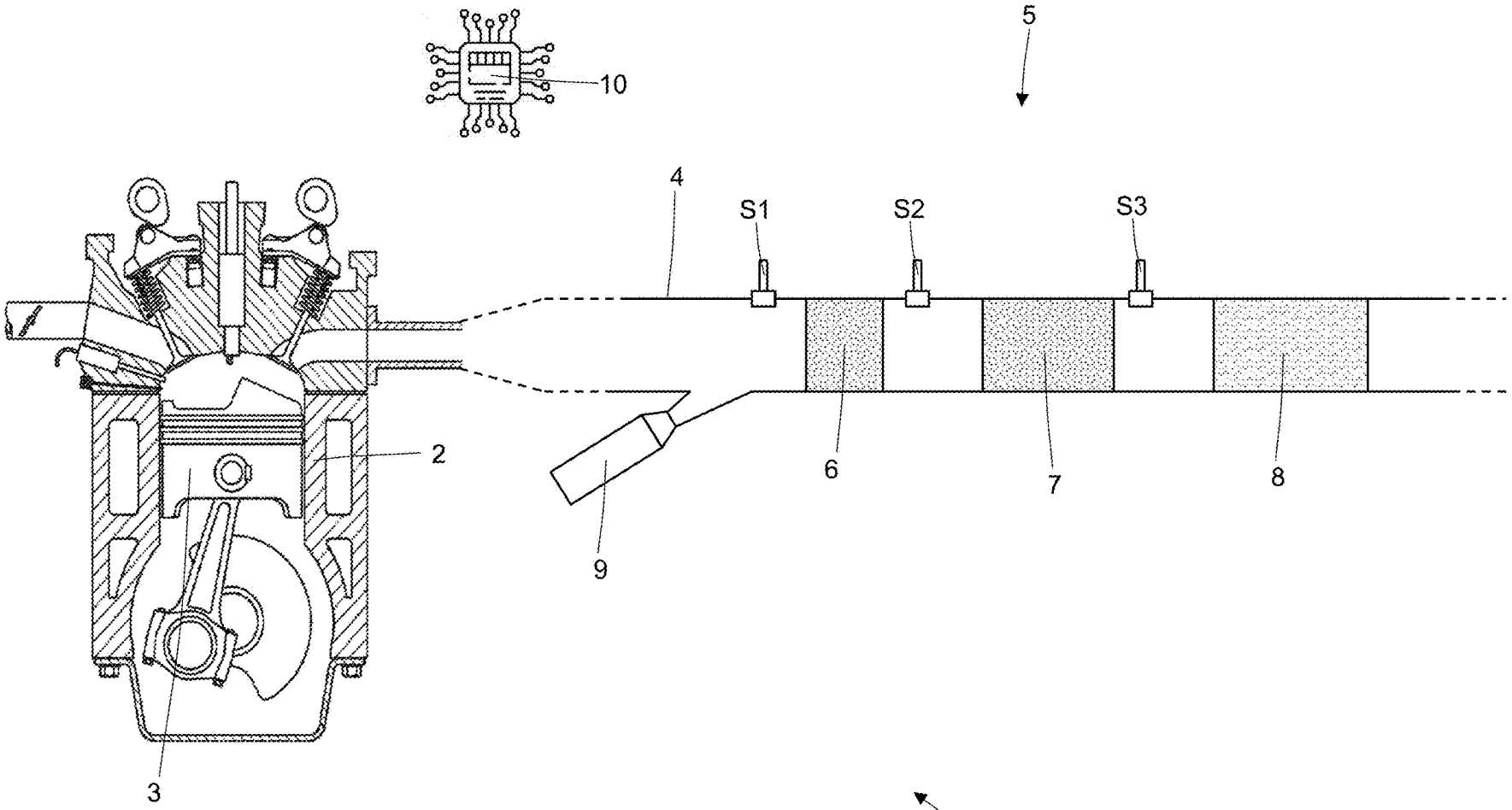
FIG. 1 is a schematic view of an internal combustion engine provided with an exhaust duct having an emission abatement system.

In FIG. 1, reference numeral 1 indicates, as a whole, a four-stroke spark ignition internal combustion engine (thus supplied with gasoline or equivalent fuels).

The internal combustion engine 1 comprises a block inside which a plurality of cylinders 2 (only one of which is illustrated in FIG. 1) is obtained. Each cylinder 2 has a combustion chamber and a piston 3 mechanically connected to a drive shaft (by means of a connecting rod) for transmitting to the drive shaft the force generated by the combustion. From the cylinders 2, an exhaust duct 4 originates which is shaped so as to input the exhaust gases into the atmosphere and is provided with an abatement system 5 of the polluting substances.

The abatement system 5 comprises a catalytic converter 6 (actually a pre-catalytic converter) arranged along the exhaust duct 4, a catalytic converter 7 arranged along the exhaust duct 4 downstream of the catalytic converter 6 and at a certain distance from the catalytic converter 6, and a particulate filter 8 arranged along the exhaust duct downstream of the catalytic converter 7 and at a certain distance from the catalytic converter 7. According to other embodiments not illustrated, the particulate filter 8 can be absent, can be a monolith on its own (as is illustrated in the accompanying figures), or can also have a catalytic function and thus coincide with the catalytic converter 7. Obviously, the structure of the abatement system 5 could be different from what is illustrated in the accompanying figures and could, for example, comprise at least one "NOx-trap".

Along the exhaust duct 4 and upstream of the catalytic converter 6, an oxygen probe S1 (also called lambda probe) is arranged which is preferably of the "UEGO" ("Universal Exhaust Gas Oxygen") type. Along the exhaust duct 4 and upstream of the catalytic converter 7 (namely between the catalytic converter 6 and the catalytic converter 7 and thus downstream of the catalytic converter 6), an oxygen probe S2 (also called lambda probe) is arranged which is preferably of the "HEGO" ("Heated Exhaust Gas Oxygen") type. Along the exhaust duct 4 and upstream of the particulate filter 8 (namely between the catalytic converter 7 and the particulate filter 8 and thus downstream of the catalytic converter 7), an oxygen probe S3 (also called lambda probe) is arranged which is preferably of the "HEGO" ("Heated Exhaust Gas Oxygen") type.

Preferably, the exhaust duct 4 is coupled to a heating device 9 which by burning fuel generates a (very) hot air flow which passes through the catalytic converters 6 and 7 for heating them when necessary and thus quickly bringing them to the operating temperature. According to different embodiments not illustrated, the heating device 9 is absent or uses electric resistances.

The internal combustion engine 1 comprises a control unit 10 which supervises the operation of the internal combustion engine 1 and, among other things, is connected to the oxygen probes S1, S2 and S3.

The combustion is a chemical reaction which takes place inside the cylinders 2 and for this chemical reaction to take place there has to be a correct proportion between the reactants consisting of fuel (gasoline) and air; in the case of gasoline, the correct proportion (called stoichiometric) by mass between the reactants is 15:1 (namely fifteen parts of air over one part of fuel) and is identified with a unitary lambda value. The internal combustion engine 1 can also operate with mixture titres different from the stoichiometric and generally comprised between 7:1 and 17:1; in the first case, the combustion in the cylinders 2 takes place with a rich air-fuel mixture (namely with excess fuel and too little oxygen with respect to the stoichiometric ratio and thus the lambda value is less than 1) and in the second case the combustion in the cylinders 2 takes place with a lean air-fuel mixture (namely with too little fuel and excess oxygen with respect to a stoichiometric ratio and thus the lambda value is greater than 1).

In general, the output signals of the oxygen probes S2 and S3 are in voltage: a unitary lambda value corresponds to a voltage output equal to a predetermined threshold (which changes from oxygen probe to oxygen probe), an output voltage lower than the threshold corresponds to a lambda greater than 1 (and thus a lean air-fuel mixture), and an output voltage greater than the threshold corresponds to a lambda less than 1 (and thus a rich air-fuel mixture). In the schematic representation of FIGS. 2 and 3, the output signals of the oxygen probes S2 and S3 are illustrated for highlighting the piece of information contained in the output signals rather than for faithfully reproducing the actual time trend in voltage of the output signals so as to make FIGS. 2 and 3 more understandable.

Figure 2:
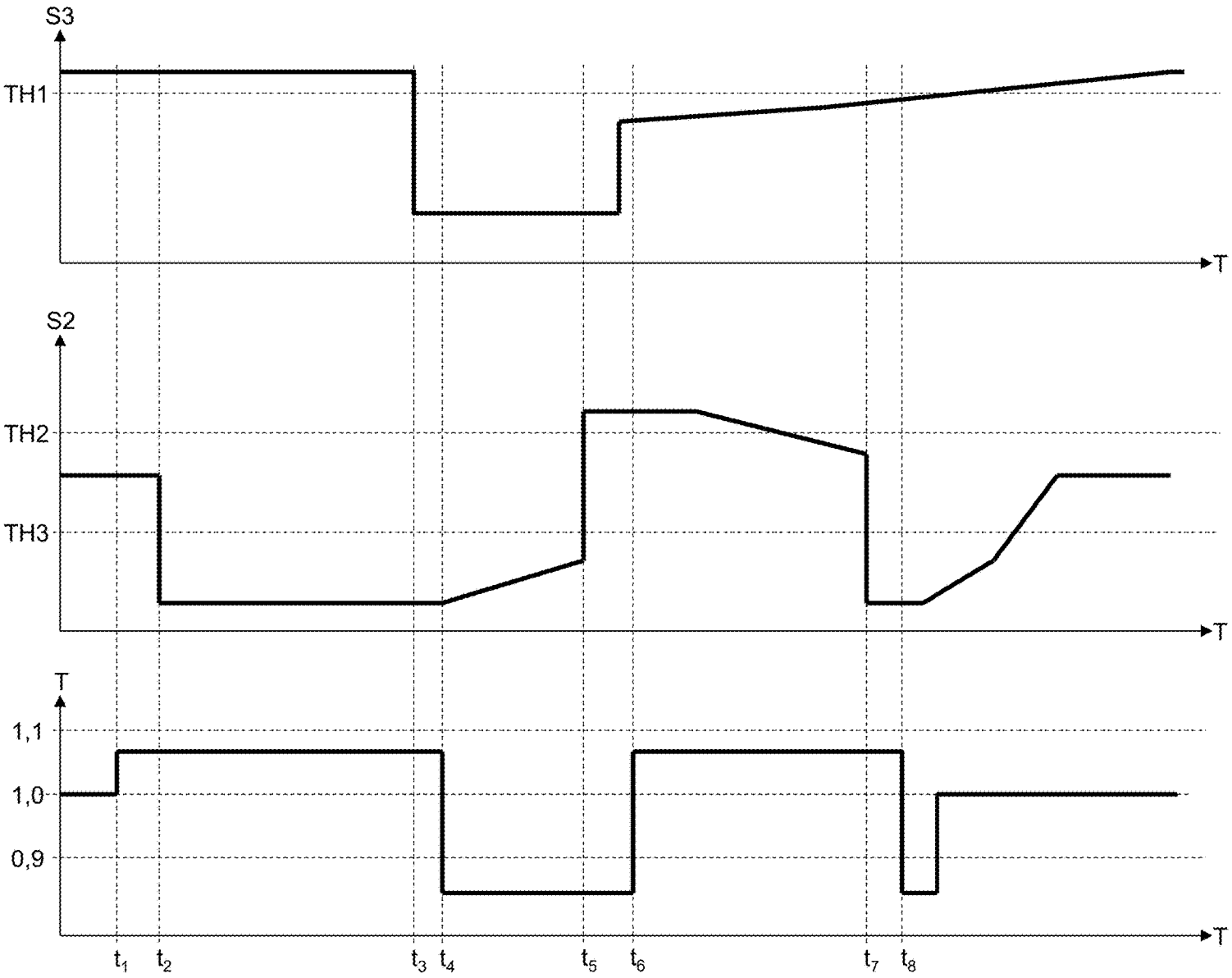
FIG. 2 illustrates diagrams that schematically illustrate the time evolution of some operating parameters of the emission abatement system while determining the oxygen storage capacity of a catalytic converter.

With reference to FIG. 2, the mode for determining the oxygen storage capacity of the catalytic converter 6 which is arranged upstream of the catalytic converter 7 along the exhaust duct 4 is described in the following. In particular, FIG. 2 illustrates the time evolution of an output signal of the oxygen sensor S3, the time evolution of an output signal of the oxygen sensor S2, and the time evolution of the titre T (namely of the air/fuel ratio) of the mixture which is burned in the combustion taking place in the cylinders 2 of the internal combustion engine 1.

Initially and starting from the instant $t_1$, an initial combustion phase is carried out in which the combustion in the cylinders 2 takes place with a lean air-fuel mixture (namely with too little fuel and excess oxygen with respect to a stoichiometric ratio); due to the excess oxygen, the initial combustion phase determines at the instant $t_2$ a reduction in the signal of the oxygen probe S2 (reduction which indicates excess oxygen) and subsequently determines at the instant $t_3$ a reduction in the signal of the oxygen probe S3 (reduction which indicates excess oxygen). When (at the instant $t_3$) the oxygen probe S3 (arranged downstream of the catalytic converter 7) signals a switch to a lean air-fuel mixture, namely when (at the instant $t_3$) an output signal of the oxygen probe S3 drops below a predetermined threshold value TH1, the initial combustion phase is terminated. In other words, the initial combustion phase is prolonged until (at the instant $t_3$) the oxygen probe S3 (arranged downstream of the catalytic converter 7) signals a switch to a lean air-fuel mixture.

Subsequently and starting from the instant $t_4$ (shortly following the instant $t_3$), an intermediate combustion phase is carried out immediately following the initial combustion phase and in which the combustion in the cylinders 2 takes place with a rich air-fuel mixture (namely with excess fuel and too little oxygen with respect to the stoichiometric ratio). The intermediate combustion phase is continued at least until (at an instant $t_5$) the oxygen probe S2 (arranged downstream of the catalytic converter 6 and upstream of the catalytic converter 7) signals a rich air-fuel mixture, namely at least until (at the instant $t_5$) an output signal of the oxygen probe S2 exceeds a predetermined threshold value TH2. In other words, at the instant $t_4$ (following the instant $t_3$), the intermediate combustion phase is started characterized by a rich air-fuel mixture (namely with excess fuel and too little oxygen with respect to the stoichiometric ratio). After (at the instant $t_5$) the oxygen probe S2 (arranged downstream of the catalytic converter 6) signals a switch to a rich air-fuel mixture, namely after (at the instant $t_5$) the output signal of the oxygen probe S2 exceeds the predetermined threshold value TH2, the intermediate combustion phase is terminated. In other words, the intermediate combustion phase is prolonged at least until (at the instant $t_5$) the oxygen probe S2 (arranged downstream of the catalytic converter 6) signals a switch to a rich air-fuel mixture.

Subsequently and starting from the instant $t_6$ (shortly following the instant $t_5$), a final combustion phase is carried out immediately following the intermediate combustion phase and in which the combustion in the cylinders 2 takes place with a lean air-fuel mixture (namely with too little fuel and excess oxygen with respect to a stoichiometric ratio). The final combustion phase is continued at least until (at an instant $t_7$) the oxygen probe S2 (arranged downstream of the catalytic converter 6 and upstream of the catalytic converter 7) signals a lean air-fuel mixture, namely after (at the instant $t_7$) an output signal of the oxygen probe S2 drops below a predetermined threshold value TH3 (smaller than the predetermined threshold value TH2). At an instant $t_8$ (shortly following the instant $t_7$), the final combustion phase is terminated and the determination of the oxygen storage capacity of the catalytic converter 6 is terminated; following the instant $t_8$, the air-fuel mixture burned in the cylinders 2 more or less quickly returns to the stoichiometric value (as it will be better described in the following). After (at the instant $t_7$) the oxygen probe S2 (arranged downstream of the catalytic converter 6) signals a switch to a lean air-fuel mixture, namely after (at the instant $t_7$) the output signal of the oxygen probe S2 drops below the predetermined threshold value TH3, the final combustion phase is terminated. In other words, the final combustion phase is prolonged at least until (at the instant $t_7$) the oxygen probe S2 (arranged downstream of the catalytic converter 6) signals a switch to a lean air-fuel mixture.

In other words, the initial phase is terminated and the intermediate phase is started (at the instant $t_4$) after (at the instant $t_3$) the output signal of the oxygen probe S3 drops below the predetermined threshold value TH1; furthermore, the intermediate phase is terminated and the final phase is started (at the instant $t_6$) after (at the instant $t_5$) the output signal of the oxygen probe S2 exceeds the predetermined threshold value TH2. Consequently, the final combustion phase is immediately subsequent the intermediate combustion phase. As said in the foregoing, during the final combustion phase the combustion in the cylinders 2 takes place with a lean air-fuel mixture (namely with too little fuel and excess oxygen with respect to a stoichiometric ratio); the final combustion phase begins after (at the instant $t_5$) the oxygen probe S2 signals a rich air-fuel mixture and terminates after (at the instant $t_7$) the oxygen probe S2 signals a lean air-fuel mixture.

The control unit 10 determines (in a known manner) a flow rate $m_{exhaust}$ of the exhaust gases flowing along the exhaust duct 4 at least during the final combustion phase. Furthermore, the control unit 10 calculates the oxygen storage capacity of the catalytic converter 6 as a function of the exhaust gas flow rate $m_{exhaust}$ at the instant $t_6$ in which the final combustion phase begins at the instant $t_7$ in which the oxygen probe S2 signals a switch from a lean air-fuel mixture to a rich air-fuel mixture (namely in which the output signal of the oxygen probe S2 drops below the predetermined threshold value TH3). Namely, the oxygen storage capacity of the catalytic converter 6 is determined calculating, as a function of the exhaust gas flow rate $m_{exhaust}$ flowing along the exhaust duct 4, the amount of oxygen entering the catalytic converter 6 between the instant $t_6$ in which the final combustion phase begins and the instant $t_7$ in which the oxygen probe S2 signals a switch from a lean air-fuel mixture to a rich air-fuel mixture.

The amount of oxygen entering the catalytic converter 6 from the instant the to the instant $t_7$ is calculated as a function of the exhaust gas flow rate $m_{exhaust}$ and as a function of an output signal λ provided by the oxygen probe S1 arranged upstream of the catalytic converter 6. In particular, the amount of oxygen entering the catalytic converter 6 from the instant $t_6$ to the instant $t_7$ is calculated integrating over time between the instant $t_6$ and the instant $t_7$ the instantaneous amount of oxygen entering the catalytic converter 6; the instantaneous amount of oxygen entering the catalytic converter 6 is obtained multiplying the exhaust gas flow rate $m_{exhaust}$ by a coefficient determined as a function of the output signal λ provided by the oxygen probe S1 arranged upstream of the catalytic converter 6.

There are different calculation methods for calculating the amount of oxygen entering the catalytic converter 6 between the instant $t_6$ and the instant $t_7$ and among these a possible calculation method for calculating the amount of oxygen entering the catalytic converter 6 between the instant $t_6$ and the instant $t_7$ is provided by the following equation (namely, the control unit 10 can calculate the oxygen storage capacity of the catalytic converter 6 using the following equation):

$$OSC = \int_{t_6}^{t_7} m_{exhaust} \cdot \frac{\lambda - 1}{\lambda} \cdot 0.23 \cdot dt$$

wherein:

OSC is the oxygen storage capacity;

$t_6$ is the beginning instant of the final combustion phase;

$t_7$ is the instant in which the oxygen probe S2 signals a switch from a lean air-fuel mixture to a rich air-fuel mixture;

$m_{exhaust}$ is the exhaust gas flow rate;

λ is an output signal provided by the oxygen probe S1 arranged upstream of the catalytic converter 6.

According to other embodiments, the control unit 10 calculates the oxygen storage capacity of the catalytic converter 6 using other equations which are different in the form but not in the substance with respect to the equation mentioned above; in particular, the equations which are used for calculating the oxygen storage capacity of the catalytic converter 6 can be different as a function of the type of output signal λ provided by the oxygen probe S1 arranged upstream of the catalytic converter 6.

In the embodiment illustrated in FIG. 2, at the termination of the final combustion phase (i.e. after the instant $t_8$), the combustion in the cylinders 2 is caused to take place in an impulsive manner (namely for a very short time interval) with a rich air-fuel mixture (namely with excess fuel and too little oxygen with respect to the stoichiometric ratio) and then it is caused to return to a stoichiometric air-fuel mixture. In other words, before returning to a stoichiometric air-fuel mixture, a quick switch to a rich air-fuel mixture (namely with excess fuel and too little oxygen with respect to the stoichiometric ratio) is caused.

Figure 3:
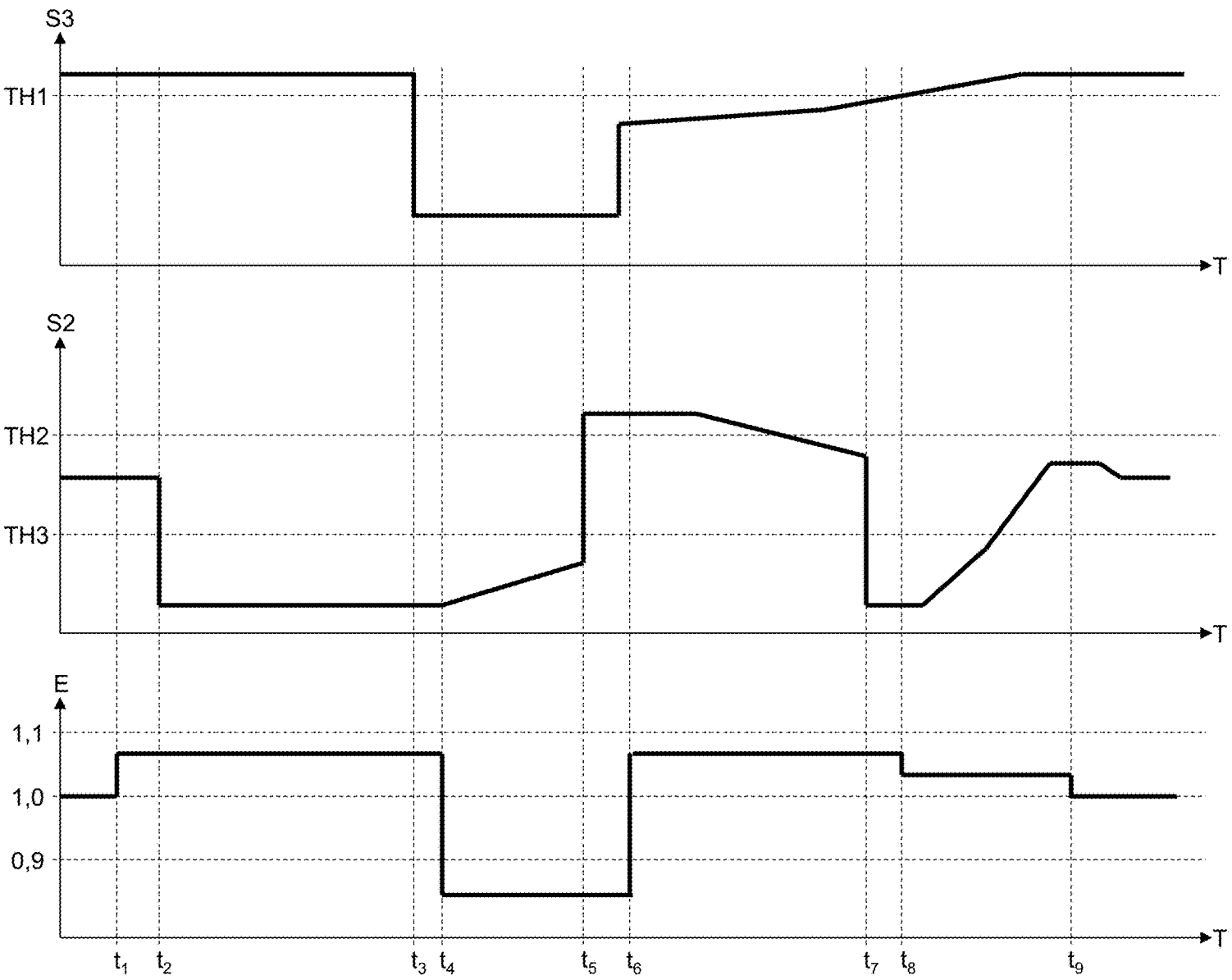
FIG. 3 illustrates diagrams that schematically illustrate the time evolution of some operating parameters of the emission abatement system while determining the oxygen storage capacity of a catalytic converter.

In the embodiment illustrated in FIG. 3, at the termination of the final combustion phase (i.e. after the instant $t_8$), the combustion in the cylinders 2 is caused to take place for a certain time interval with a lean air-fuel mixture (namely with too little fuel and excess oxygen with respect to a stoichiometric ratio) and then it is caused (at the instant $t_9$) to return to a stoichiometric air-fuel mixture. Obviously, the duration of the time interval passing between the instants $t_8$ and $t_9$ can be calibrated, namely is variable. According to a possible (but not limiting) embodiment, immediately after the final combustion phase (i.e. after the instant $t_8$), the combustion in the cylinders 2 is caused to take place with a lean air-fuel mixture having excess oxygen to a smaller extent than the excess oxygen of the final combustion phase; alternatively, immediately after the final combustion phase (i.e. after the instant $t_8$), the combustion in the cylinders 2 is caused to take place with a lean air-fuel mixture having the same excess oxygen of the final combustion phase or having excess oxygen greater than the excess oxygen of the final combustion phase. By operating in this manner, the efficiency of the catalytic converters 6 and 7 at the termination of the estimation of the oxygen storage capacity is improved; namely the estimation of the oxygen storage capacity is terminated at the instant $t_8$ and the adding of a further period (until the instant $t_9$) in which the combustion in the cylinders 2 is caused to take place with a lean air-fuel mixture allows storing further oxygen inside the catalytic converters 6 and 7 for improving the following control of the mixture titre and thus minimize the emissions of CO and NOx.

According to an alternative embodiment not illustrated, at the termination of the final combustion phase (i.e. after the instant $t_8$) the combustion in the cylinders 2 is caused to immediately return to a stoichiometric air-fuel mixture without any (more or less quick) switch to a rich air-fuel mixture (namely with excess fuel and too little oxygen with respect to the stoichiometric ratio) as is illustrated in FIG. 2 or to a lean air-fuel mixture (namely with too little fuel and excess oxygen with respect to a stoichiometric ratio), as is illustrated in FIG. 3.

It is important to observe that the abatement system 5 can comprise a greater number of catalytic converters with respect to what illustrated in the accompanying figures, considering that the actuation mode will always use the values of the intermediate oxygen probes and at the end of the last catalytic converter, with similar strategies, for performing the estimation of the oxygen storage capacity.

The embodiments described herein can be combined with one another without departing from the scope of protection of the present invention.

The estimation method described above has numerous advantages.

Firstly, the estimation method described above allows reducing the polluting emissions, and in particular the emissions of carbon monoxide (CO), while determining the oxygen storage capacity of the catalytic converter 6 and especially without penalizing the emissions of nitrogen oxide (NOx). This result is obtained by prolonging the initial combustion phase at least until (at the instant $t_3$) the oxygen probe S3 arranged downstream of the catalytic converter 7 signals a switch to a lean air-fuel mixture, namely until the catalytic converter 7 is completely filled with oxygen. In this manner, during the following intermediate combustion phase, the emissions of carbon monoxide (CO) which are released by the catalytic converter 6 are abated in an effective manner by the catalytic converter 7 exploiting the oxygen that the catalytic converter 7 has stored during the initial combustion phase.

Furthermore, the estimation method described above allows for a very precise control of the oxygen probes S1, S2 and S3 thus managing to avoid the generation of NOx at the exhaust.

Finally, the estimation method described above is simple and cost-effective to implement, as it does not require any hardware modification and does not involve high computing power or a large amount of memory.

LIST OF REFERENCE NUMERALS OF THE FIGURES

1 internal combustion engine
2 cylinders
3 pistons
4 exhaust duct
5 abatement system
6 catalytic converter
7 catalytic converter
8 particulate filter
9 heating device
10 control unit
S1 oxygen probe
S2 oxygen probe
S3 oxygen probe
T titre
$t_1$ instant
$t_2$ instant
$t_3$ instant
$t_4$ instant
$t_5$ instant
$t_6$ instant
$t_7$ instant
$t_8$ instant
$t_9$ instant

The invention claimed is:

1. An estimation method for determining the oxygen storage capacity of a first catalytic converter (6), which is arranged upstream of a second catalytic converter (7) along an exhaust duct (4) of an internal combustion engine (1) provided with at least one cylinder (2); the estimation method comprises the steps of:

carrying out an initial combustion phase, in which the combustion in the cylinder (2) takes place with a lean air-fuel mixture, namely with too little fuel and excess oxygen with respect to a stoichiometric ratio;

carrying out an intermediate combustion phase immediately following the initial combustion phase and in which the combustion in the cylinder (2) takes place with a rich air-fuel mixture, namely with excess fuel and too little oxygen with respect to the stoichiometric ratio, at least until a first oxygen probe (S2) arranged downstream of the first catalytic converter (6) and upstream of the second catalytic converter (7) signals a rich air-fuel mixture;

carrying out a final combustion phase immediately following the intermediate combustion phase and in which the combustion in the cylinder (2) takes place with a lean air-fuel mixture, namely with too little fuel and excess oxygen with respect to a stoichiometric ratio, after the first oxygen probe (S2) signals a rich air-fuel mixture and at least until the first oxygen probe (S2) signals a lean air-fuel mixture;

determining a flow rate ($m_{exhaust}$) of the exhaust gases flowing along the exhaust duct (4) at least during the final combustion phase; and calculating the oxygen storage capacity of the first catalytic converter (6) calculating, as a function of the exhaust gas flow rate ($m_{exhaust}$), the amount of oxygen entering the first catalytic converter (6) from a first instant ($t_6$), in which the final combustion phase begins, to a second instant ($t_7$), in which the first oxygen probe (S2) signals a switch from a lean air-fuel mixture to a rich air-fuel mixture;

wherein the initial combustion phase is prolonged until a second oxygen probe (S3) arranged downstream of the second catalytic converter (7) signals a switch to a lean air-fuel mixture.

2. The estimation method according to claim 1, wherein the initial combustion phase is prolonged until an output signal of the second oxygen probe (S3) drops below a first predetermined threshold value (TH1).

3. The estimation method according to claim 1, wherein the intermediate phase is terminated and the final phase is started after an output signal of the first oxygen probe (S2) exceeds a second predetermined threshold value (TH2).

4. The estimation method according to claim 1, wherein the second instant ($t_7$) is determined when an output signal of the first oxygen probe (S2) drops below a third predetermined threshold value (TH3).

5. The estimation method according to claim 4, wherein the final phase is terminated after the output signal of the first oxygen probe (S2) drops below the third predetermined threshold value (TH3).

6. The estimation method according claim 1, wherein the amount of oxygen entering the first catalytic converter (6) from the first instant (to) to the second instant ($t_7$) is calculated as a function of the exhaust gas flow rate ($m_{exhaust}$) and as a function of an output signal ($\lambda$) provided by a third oxygen probe (S1) arranged upstream of the first catalytic converter (6).

7. The estimation method according to claim 6, wherein the amount of oxygen entering the first catalytic converter (6) from the first instant ($t_6$) to the second instant ($t_7$) is calculated integrating over time between the first instant ($t_6$) and the second instant ($t_7$) the instantaneous amount of oxygen entering the first catalytic converter (6).

8. The estimation method according to claim 7, wherein the instantaneous amount of oxygen entering the first catalytic converter (6) is obtained multiplying the exhaust gas flow rate ($m_{exhaust}$) by a coefficient determined as a function of the output signal ($\lambda$) provided by the third oxygen probe (S1) arranged upstream of the first catalytic converter (6).

9. The estimation method according to claim 1, wherein the oxygen storage capacity of the first catalytic converter (6) is calculated using the following equation:

$$OSC = \int_{t_6}^{t_7} m_{exhaust} \cdot \frac{\lambda - 1}{\lambda} \cdot 0.23 \cdot dt$$

wherein:

OSC is the oxygen storage capacity;

$t_6$ is the first instant;

$t_7$ is the second instant;

$m_{exhaust}$ is the exhaust gas flow rate;

$\lambda$ is an output signal provided by a third oxygen probe (S1) arranged upstream of the first catalytic converter (6).

10. The estimation method according to claim 1, wherein, immediately after the final combustion phase, the combustion in the cylinder (2) is caused to take place in an impulsive manner with a rich air-fuel mixture, namely with excess fuel and too little oxygen with respect to the stoichiometric ratio, and then it is caused to return to a stoichiometric air-fuel mixture.

11. The estimation method according to claim 1, wherein, immediately after the final combustion phase, the combustion in the cylinder (2) is caused to take place with a lean air-fuel mixture, namely with too little fuel and excess oxygen with respect to a stoichiometric ratio, and then it is caused to return to a stoichiometric air-fuel mixture.

12. The estimation method according to claim 10, wherein, immediately after the final combustion phase, the combustion in the cylinder (2) is caused to take place with a lean air-fuel mixture having excess oxygen to a smaller extent than the excess oxygen of the final combustion phase.

13. The estimation method according to claim 1, wherein, immediately after the final combustion phase, the combustion in the cylinder (2) is immediately caused to return to a stoichiometric air-fuel mixture.

14. An internal combustion engine (1) comprising:

at least one cylinder (2);

an exhaust duct (4) provided with a first catalytic converter (6) and with a second catalytic converter (7) arranged downstream of the first catalytic converter (6);

a first oxygen probe (S2) arranged downstream of the first catalytic converter (6);

a second oxygen probe (S3) arranged downstream of the second catalytic converter (7);

a third oxygen probe (S1) arranged upstream of the first catalytic converter (6); and a control unit (10) configured to implement the estimation method according to claim 1.

* * * * *